US009337536B1

(12) United States Patent
Paulsen et al.

(10) Patent No.: US 9,337,536 B1
(45) Date of Patent: May 10, 2016

(54) ELECTRONICALLY STEERABLE SATCOM ANTENNA

(75) Inventors: Lee M. Paulsen, Cedar Rapids, IA (US); Michael J. Buckley, Marion, IA (US); James B. West, Cedar Rapids, IA (US); Jeremiah D. Wolf, Marion, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 259 days.

(21) Appl. No.: 13/447,336

(22) Filed: Apr. 16, 2012

(51) Int. Cl.
*H01Q 3/00* (2006.01)
*H01Q 3/26* (2006.01)

(52) U.S. Cl.
CPC ..... *H01Q 3/2664* (2013.01)

(58) Field of Classification Search
USPC ..... 343/700 MS, 702, 765, 766
See application file for complete search history.

(56) References Cited

U.S. PATENT DOCUMENTS 5,223,845 A * 6/1993 Eguchi ..... H01Q 3/08 342/359

* cited by examiner

*Primary Examiner* — Hoang V Nguyen
*Assistant Examiner* — Hai Tran
(74) *Attorney, Agent, or Firm* — Angel N. Gerdzhikov; Donna P. Suchy; Daniel M. Barbieri

(57) ABSTRACT

A hybrid satellite antenna comprises an ESA with two steerable dimensions connected to a motor. The motor rotates the antenna about an axis to position the antenna such that a satellite signal can be sufficiently resolved using the two steerable dimensions of the ESA.

20 Claims, 8 Drawing Sheets

ELECTRONICALLY STEERABLE SATCOM ANTENNA

FIELD OF THE INVENTION

The present invention is directed generally toward satellite antennas and more particularly to satellite antennas configured for a dynamic environment.

BACKGROUND OF THE INVENTION

Satellite communication requires precise antenna positioning. When attempting geosynchronous satellite communication from a stationary or nearly stationary location, a satellite antenna, once properly positioned, may require little or no adjustment. When adjustments are required, they are predictable and easily accomplished.

However, when attempting satellite communication on the move, the satellite antenna must be constantly and precisely adjusted and repositioned. For example, a satellite antenna affixed to a vehicle must be able to point the beam to within less than 0.5° of a desired orientation while the vehicle is moving; vehicle movement could create a dynamically shifting environment requiring angular acceleration of $120°/s^2$. Satellite communication on the move (SOTM) requires full hemispherical coverage. In addition, Low Earth Orbiting (LEO) satellites are not geosynchronous and therefore require continuous tracking.

Electronically steerable antennas (ESAs) can achieve a pointing accuracy of less than 0.5° but any individual planar ESA has only a limited steering range. Planar arrays are the least complex and most commonly used ESA; therefore, multiple planar, expensive ESAs are required to achieve full hemispherical coverage. Spherical ESA are capable of full hemispherical coverage but they are large, complex, expensive and aerodynamically unattractive for airborne applications.

Mechanically steerable antennas with two dimensions of movement can achieve full hemispherical coverage with a single antenna. However, the motion control system for military sitcom on the move (SOTM) is extremely complex and costly. It is very challenging to hold a lock on a satellite system while traversing over rough terrain in a ground vehicle when the SOTM antenna has a very narrow beam width, which can be a on the order of 1 degree for Q band systems. The inertial mass, moment arm and center of gravity of the antenna group (antenna positioner, RF front end, modem, etc.) of a typical SOTM antenna group makes motion control with high rates of acceleration with pointing accuracies within 0.5° very challenging. The required motion control systems are expensive, heavy and subject to mechanical failure. Furthermore, mechanically steerable systems are inherently slower than electronically steerable systems.

Consequently, it would be advantageous if a lightweight, cost-effective apparatus existed that is suitable for accurately positioning a satellite antenna in a dynamic environment.

SUMMARY OF THE INVENTION

Accordingly, the present invention is directed to a novel method and lightweight, cost-effective apparatus for accurately positioning a satellite antenna in a dynamic environment.

One embodiment of the present invention is hybrid antenna with a planar ESA, steerable in two dimensions, mounted to an azimuthal motor. The ESA is mounted to the motor such that the motor can rotate the ESA about an axis to provide 360° of gross movement while the ESA itself provides fine tuning in the azimuth. The ESA is also mounted to the motor at an angle to a horizontal plane so that the range of one of the steerable dimensions in the ESA provides adequate coverage of elevation for satellite systems of interest.

Another embodiment of the present invention is a method for steering a hybrid antenna. The method includes monitoring signal strength in an ESA while performing gross position adjustments with an azimuthal motor, then electronically performing fine adjustments in a first steerable dimension of the ESA and electronically performing fine adjustments in a second steerable dimension of the ESA.

It is to be understood that both the foregoing general description and the following detailed description are exemplary and explanatory only and are not restrictive of the invention claimed. The accompanying drawings, which are incorporated in and constitute a part of the specification, illustrate an embodiment of the invention and together with the general description, serve to explain the principles.

BRIEF DESCRIPTION OF THE DRAWINGS

The numerous objects and advantages of the present invention may be better understood by those skilled in the art by reference to the accompanying figures in which.

DETAILED DESCRIPTION OF THE INVENTION

Reference will now be made in detail to the subject matter disclosed, which is illustrated in the accompanying drawings. The scope of the invention is limited only by the claims; numerous alternatives, modifications and equivalents are encompassed. For the purpose of clarity, technical material that is known in the technical fields related to the embodiments has not been described in detail to avoid unnecessarily obscuring the description.

Figure 1:
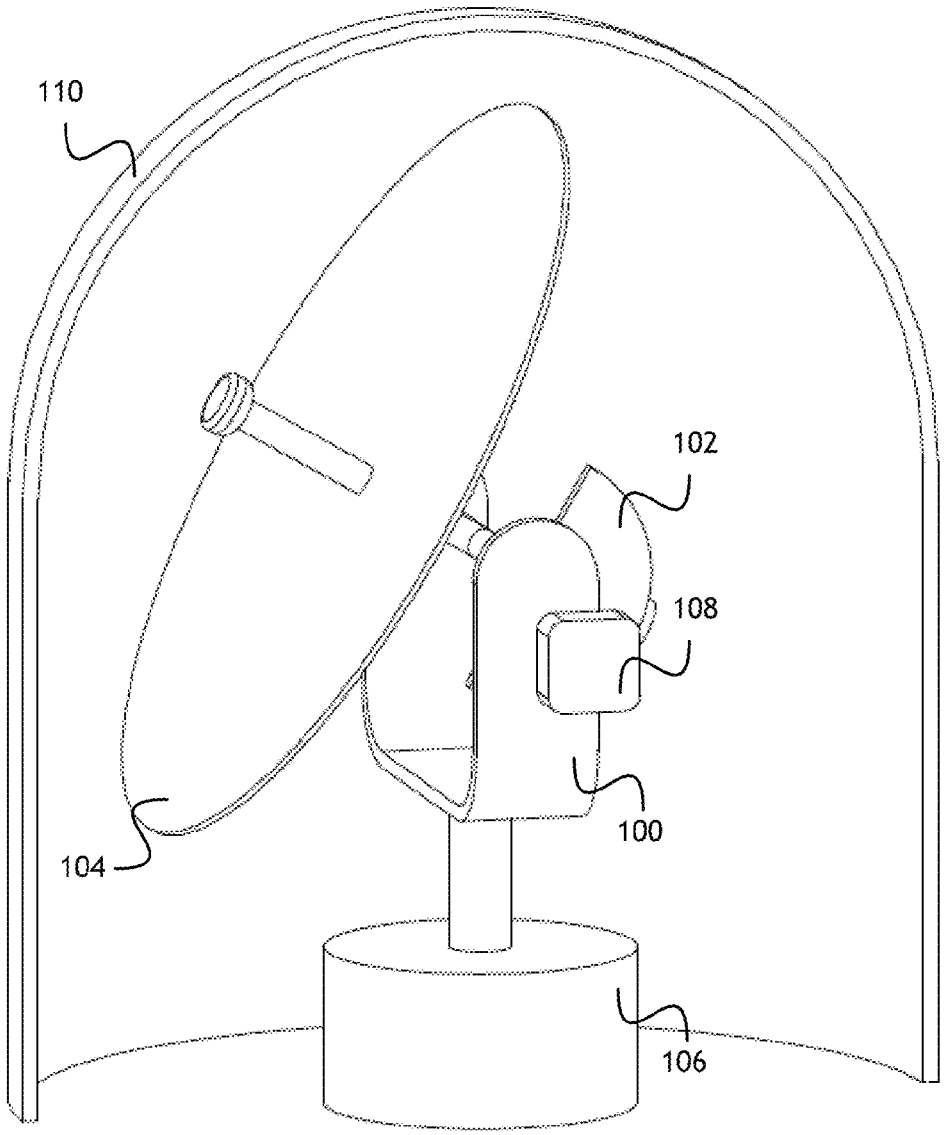
FIG. 1 shows a perspective view of a mechanically steerable satellite antenna with two dimensions of mobility.

Referring to FIG. 1, a perspective view of a mechanically steerable satellite antenna is shown. A mechanically steerable satellite antenna may include an azimuth positioning mechanism 100 connected to an azimuth positioning motor 106. The azimuth positioning mechanism 100 may support an elevation positioning mechanism 102 and elevation positioning motor 108. The elevation positioning mechanism 102 may rotate an antenna 104 about an axis substantially parallel to the horizon to orient the antenna 104 to point toward a desired elevation. The entire mechanically steerable satellite antenna may be housed inside of a radome 110.

Because satellite communication requires accurate positioning and orientation of the antenna to within 0.5°, a control system must be able to rotate the azimuth positioning unit to within 0.5° of a desired orientation and maintain such orientation even under stress due to external motion and acceleration of the host vehicle. Furthermore, the elevation positioning mechanism 102 adds additional weight to the azimuth positioning mechanism 100, which therefore adds additional momentum during positioning which must be compensated for by the control system and by stiff bearings and a powerful motor. The elevation positioning mechanism 102 also requires stiff bearings to achieve elevation orientation within 0.5°.

Stiff bearings and correspondingly powerful yet precise motors and precision control systems are expensive. Mechanically steerable satellite antennas are also large, necessitating a large radome 110 that decreases the aerodynamic efficiency of the vehicle housing the antenna for airborne applications.

Figure 2:
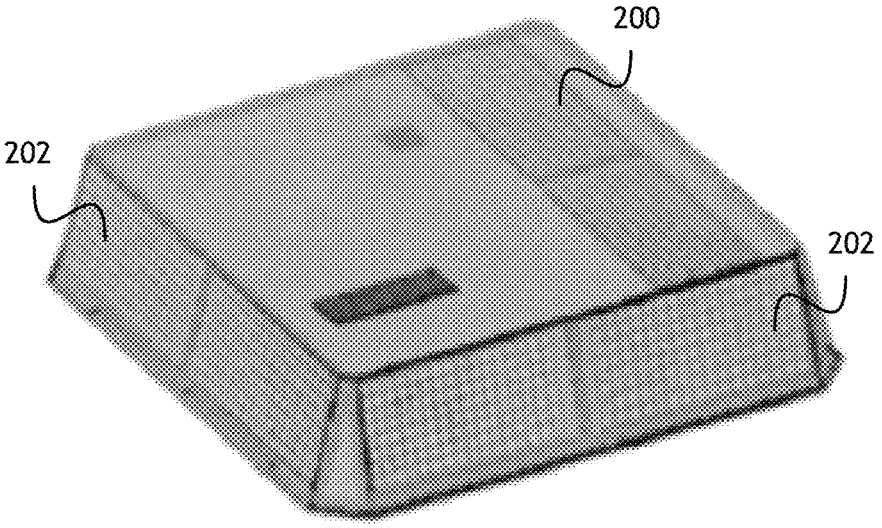
FIG. 2 shows a perspective view of an electronically steerable satellite antenna.

Referring to FIG. 2, a perspective view of a multi-panel ESA is shown. The receive array is abutted to the transmit array for each of the panels shown. The ESA includes one or more planar receiving arrays 200, and a plurality of planar transmitting arrays 202. An ESA panel may also be configured as one or more arrays in a common aperture such that the transmitting array 202 and receiving array 200 potentially share at least one common radiating element. Another ESA panel configuration is a "nested" transmit array superimposed within the receive array. The transmit and receive arrays are then effectively "interlaced". The configuration of FIG. 2 offers optimal performance and the applicability of the other configurations described depend on the harshness of ESA systems requirements. ESAs are also called phased array antennas; the beam from a phased array antenna may be steered by electronically adjusting the individual phase shifter of each radiating element in the phased array to create constructive and destructive interference that nullifies the beam in undesirable directions and enhances the beam in desirable direction; i.e. the beam is effectively "steered" to the desired elevation and azimuth position. Two-dimensional planar phased array antennas are operable to steer a beam within a conical volume as referenced to the axis normal to the surface of the phased array antenna panel. The structure and design of a phased array antenna may determine the scan volume in which the phased array antenna can steer a beam. Steering a beam with a phased array antenna is very fast as compared to a mechanically steerable antenna since phase shifter adjustments can typically be made on the order of tens of microseconds. A single, spherical phased array antenna may realize full hemispherical scan volume, but may be more expensive and significantly higher profile.

An ESA such as in FIG. 2 may be statically mounted to a vehicle. Where transmitting arrays 202 are oriented substantially perpendicular to each other in a plane defined by the azimuth, four transmitting arrays 202 may technically cover substantially the entire hemisphere. However, each transmitting array 202 may not provide the same signal integrity as a beam is steered away from the direction normal to the surface of the transmitting array 202. The scan volume of a planar phased array panel, in a single dimension, can be predicted by the equation: $\text{Gain}=G_o*\cos^n(\theta)$, where θ is the angle the beam scans off array normal and $G_o$ is the gain at array normal. For an ideal array, n=1.0 and n is greater than one for actual phased arrays. This equation readily shows that the gain progressively becomes less as the array is scanned off array normal.

Where a satellite is positioned at the periphery of the effective view (i.e. off perpendicular) of any one transmitting array 202, performance of the ESA may be compromised. Also, where the receiving array 200 is fixed in a certain position, the receiving array 200 cannot be oriented to improve signal integrity on the receiving end. Furthermore, phased array antennas are expensive; a hemispherical coverage ESA necessarily requires enough phased array antennas to cover the entire hemisphere at all times.

Figure 3:
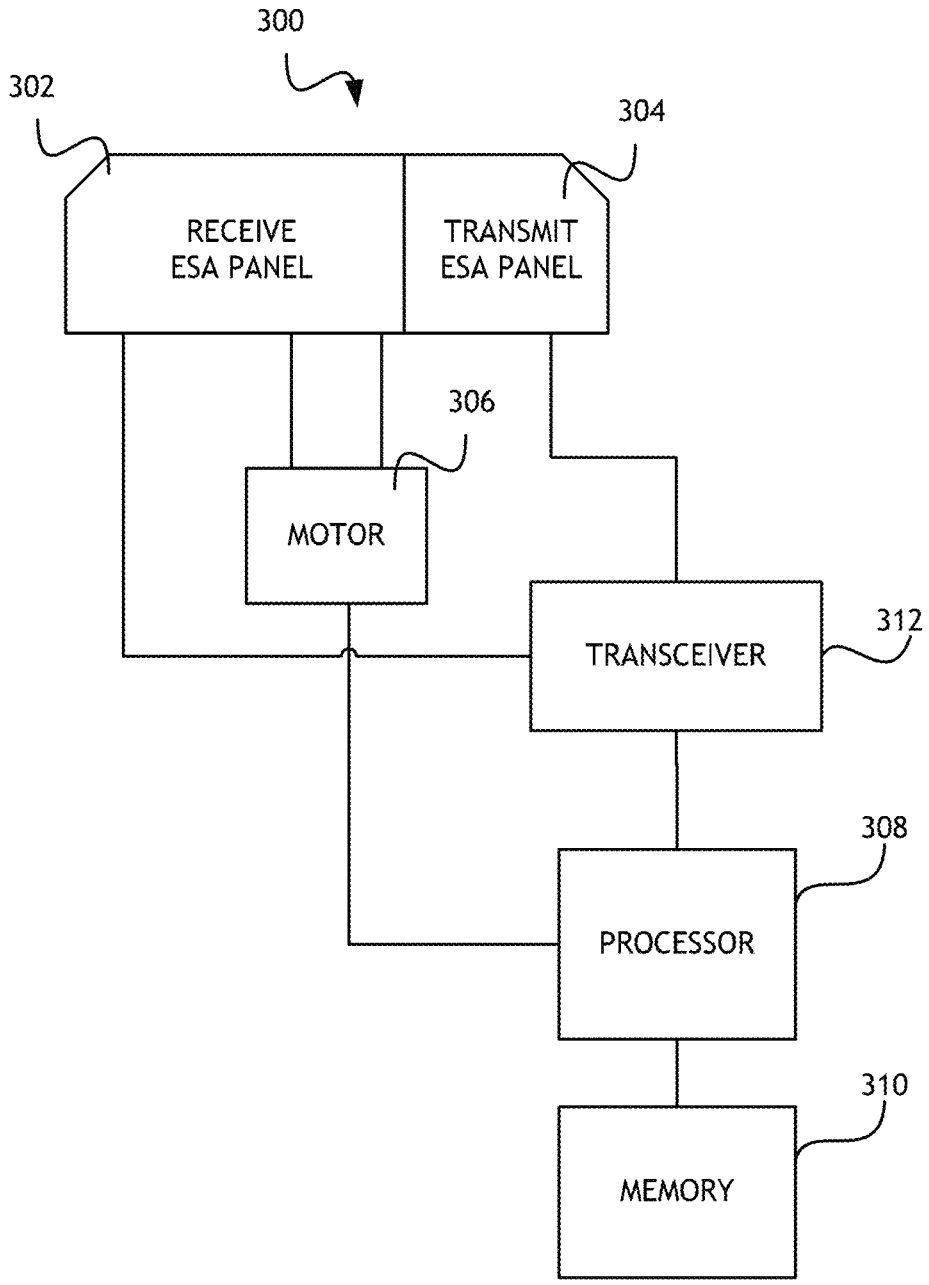
FIG. 3 shows a block diagram of a hybrid satellite antenna according to the present invention.

Referring to FIG. 3, a block diagram of a hybrid satellite antenna is shown. The hybrid satellite antenna may comprise a combined phased array 300. The combined phased array may comprise a receive ESA panel 302 and a transmit ESA panel 304. Both the receive ESA panel 302 and transmit ESA panel 304 may have substantially the same orientation such that each of the receive ESA panel 302 and transmit ESA panel 304 may communicate with the same satellite at the same time. The combined phased array 300 may be connected to a motor 306. The motor 306 may rotate the combined phased array 300 about an axis. One skilled in the art may appreciate that although a combined phased array 300 having separate receive ESA panel 302 and transmit ESA panel 304 is shown, an ESA may be configured as one or more arrays interlaced such that a transmitting array and receiving array potentially share at least one common radiating element (cell).

The motor 306 may be connected to a processor 308 and the processor 308 may be connected to memory 310 for storing computer executable program code. The processor 308 may actuate the motor 306 to rotate the combined phased array 300 about the axis to an azimuth with sufficient precision that the combined phased array may electronically adjust a beam to achieve optimal signal integrity. The processor 306 may be connected to a transceiver 312 that is further connected to the receive ESA panel 302 and to the transmit ESA panel 304. The transceiver 312 may relay signals to the transmit ESA panel 304 from the processor 308 and relay signals from the receive ESA panel 302 to the processor 308. The processor 308 may monitor signal strength through the receive ESA panel 302 to determine when to actuate the motor 306 and when to electronically adjust the combined phased array 300.

Recall that the scan volume of a planar phased array panel, in a single dimension, can be predicted by the equation: $\text{Gain}=G_o*\cos^n(\theta)$, where θ is the angle the beam scans off array normal and $G_o$ is the gain at array normal. The hybrid configuration proposed herein minimizes azimuthal scan loss by the use of the azimuthal motor. Furthermore, because the phased array panel 300 is light weight, and offers final azimuthal beam adjustment via electronic beam scanning, the motion control system (306/308/310) may be much simpler and less expensive as compared to those used in traditional 2-axis mechanically steered SOTM systems.

Figure 4:
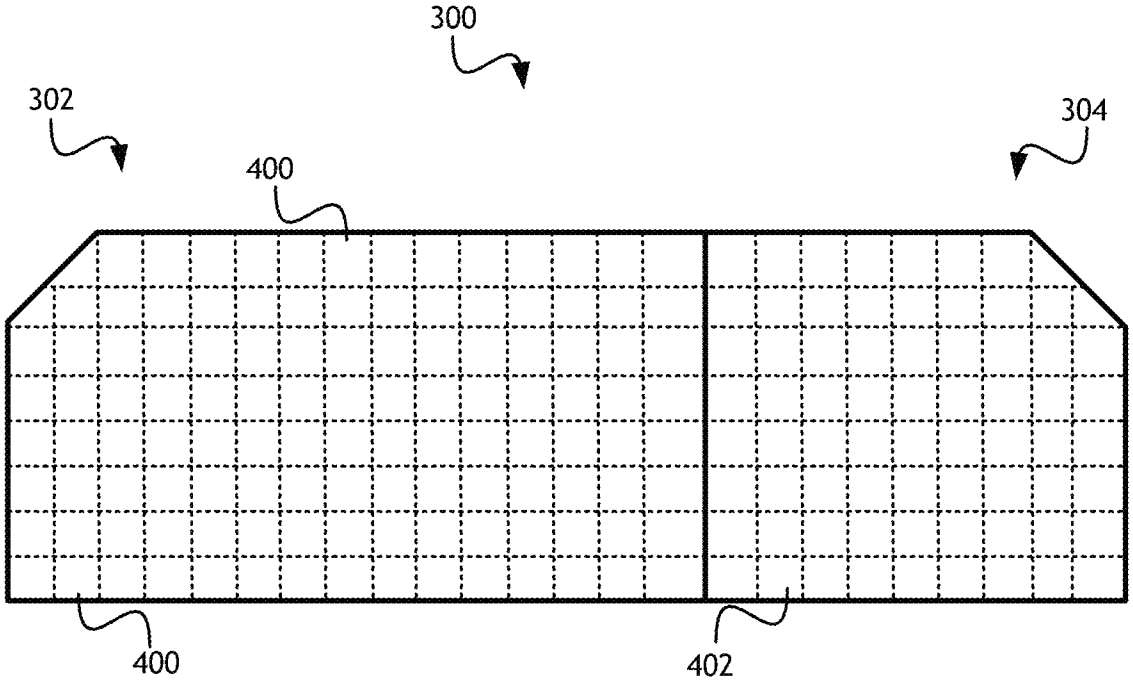
FIG. 4 shows a block diagram of a combined phased array for a hybrid satellite antenna such as shown in FIG. 3.

Referring to FIG. 4, a detailed view of a combined phased array 300 is shown. The combined phased array 300 may include a receive ESA panel 302 and a transmit ESA panel 304. The receive ESA panel 302 may comprise a plurality of array cells 400 and the transmit ESA panel 304 may comprise a plurality of array cells 402. Each array cell 400 may be a component of a receive phased array, configured to interact with other of the plurality of array cells 400 to produce a directional beam. Array cells 400 contain phase shifter modules to electronically steer the receive beam. In addition, an array cell 400 may contain receive modules which include T/R switches, phase shifters, attenuators, low noise amplifiers (LNA) and limiter functions. The relative phase shift between each of the array cells 400 determines the beam pointing position relative to the array normal.

Each array cell 402 may be a component of a transmit phased array, configured to interact with other of the plurality of array cells 402 to produce a directional beam. Array cells 402 contain phase shifter modules to electronically steer the transmit beam. In addition, an array cell 402 may contain receive modules which include T/R switches, phase shifters, attenuators, and power amplifier functions. The relative phase shift between each of the array cells 402 determines the beam pointing position relative to the array normal.

Figure 5:
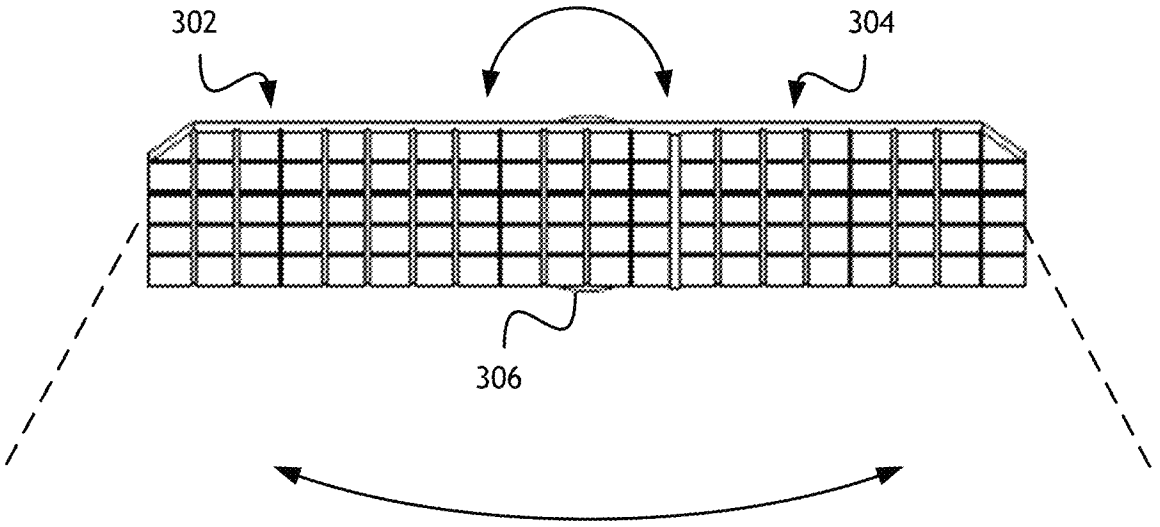
FIG. 5 shows a top view diagram of a hybrid satellite antenna.

Referring to FIG. 5, a top view of a hybrid satellite antenna is shown. When a hybrid satellite antenna is mounted in a vehicle, the hybrid satellite antenna may be oriented such that the motor 306 (obscured by the combined phased array) may rotate the combined phased array in the azimuth plane. The motor 306 may make gross adjustments to the position of the combined phased array in the azimuth as the vehicle is moving. The motor 306 may adjust the position of the combined phased array to a minimum precision such that the processor may electronically adjust array cells in phased array columns and phased array rows to steer a beam to within 0.5° of a desired orientation. The processor may continue to make electronic adjustments as necessary to maintain desired signal strength.

Figure 6:
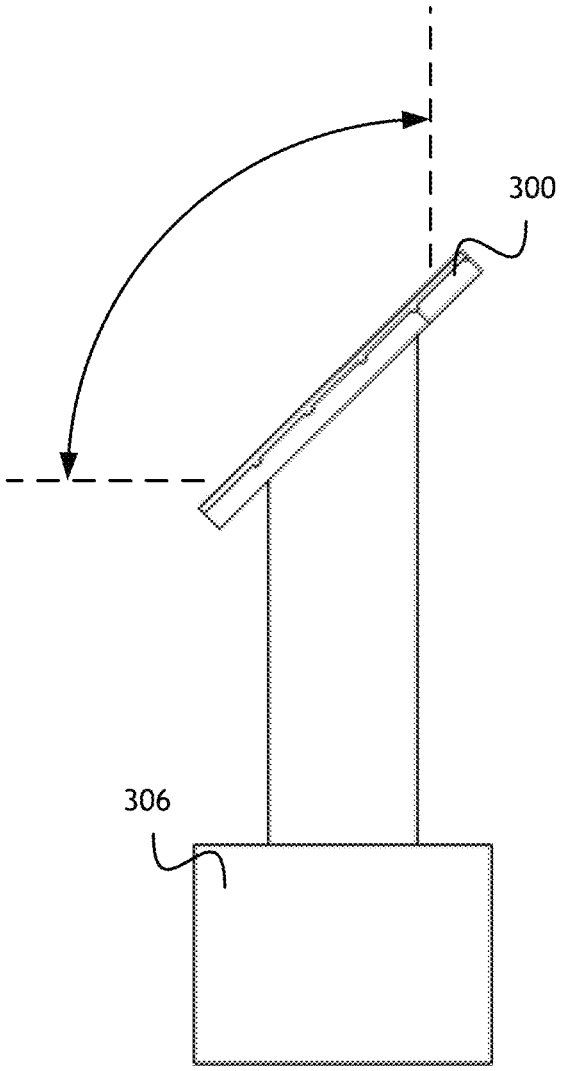
FIG. 6 shows a side view diagram of a hybrid satellite antenna.

Referring to FIG. 6, a side view of a diagram of a hybrid satellite antenna is shown. A satellite antenna must be able to adjust the orientation of a beam along an elevation as well as an azimuth. The combined phased array 300 may be oriented such that the operational surface of the combined phased array 300 is oriented away from the horizon when the hybrid satellite antenna is mounted in a vehicle. The combined phased array 300 may be oriented such that the phased array rows may steer a beam within an elevation range of between 0° and 90° relative to the horizon. The nominal elevation angle of orientation of combined phased array 300 is designed such that the array normal generally points in the elevation angle of the desired satellite being communicated. This minimizes scan loss in the elevation plane while at the same time maintaining a low profile for the hybrid satellite antenna assembly. The orientation of the combined phased array 300 may remain substantially unchanged relative to the horizon as the motor 306 rotates the combined phased array 300. The processor may electronically adjust array cells in phased array rows (elevation scanning) and phased array columns (azimuthal scanning) to steer a beam to within 0.5° of a desired elevation. The processor may continue to make electronic adjustments as necessary to maintain a desired signal strength.

A hybrid satellite antenna according to the present invention may utilize a motor, bearings and control system conforming to less rigorous standards as compared to satellite antennas known in the art. A hybrid satellite antenna according to the present invention may also utilize a single phase array antenna as opposed to multiple, expensive phased array antennas. A hybrid satellite antenna according to the present invention may track a desired satellite signal while in a moving vehicle, even under conditions requiring tracking velocity of 60°/s and tracking acceleration of $120°/s^2$.

Figure 7:
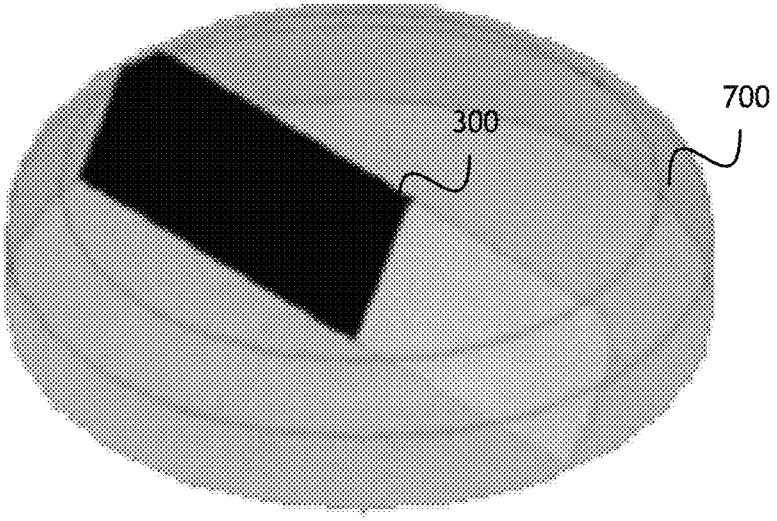
FIG. 7 shows a perspective view of a hybrid satellite antenna in a radome.

Referring to FIG. 7, a hybrid satellite antenna 300 in a radome 700 is shown. A hybrid satellite antenna according to the present invention may have the smallest possible footprint of any satellite antenna with any type of mechanical steering, having an antenna of comparable size and capability (hemispherical coverage). A hybrid satellite antenna according to the present invention may be placed inside a radome 700 having a diameter defined by the size of the combined phased array 300 and a height defined by the size of the combined phased array 300 as it is angled relative to the horizon. By comparison, the solely mechanically steerable antenna described in FIG. 1 may require a larger radome for a similarly sized antenna.

Figure 8:
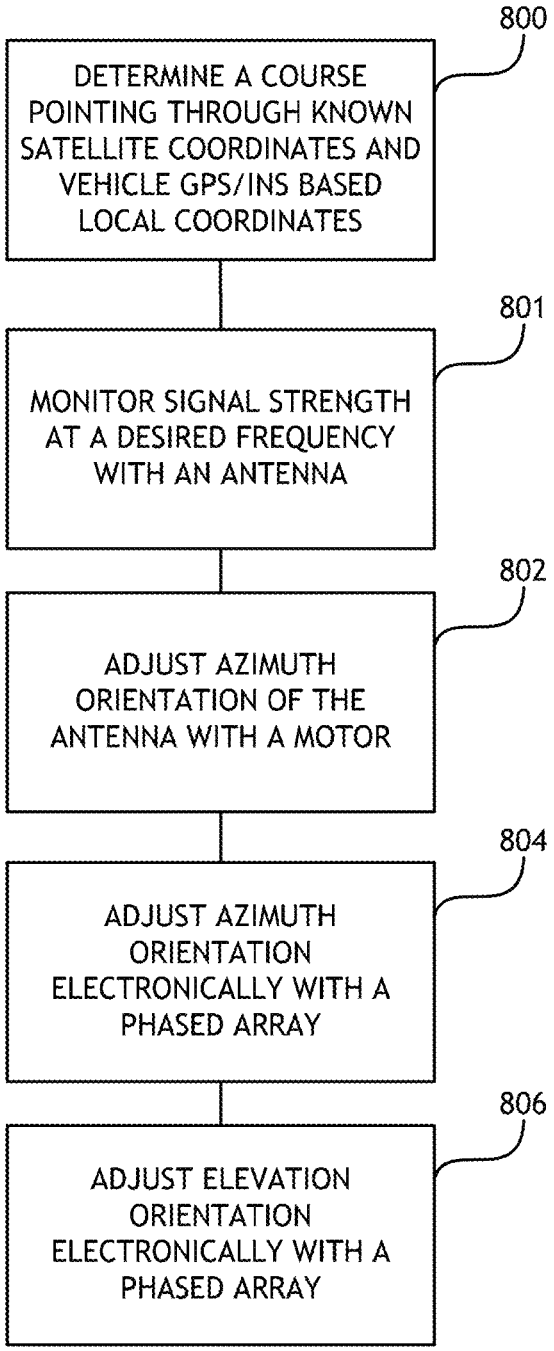
FIG. 8 shows a flowchart of a method for orienting a hybrid satellite antenna.

Referring to FIG. 8, a flowchart is shown for a method of orienting a hybrid satellite antenna. A processor may determine 800 an initial course pointing adjustment of the azimuthal motor and elevation/azimuth scan of the ESA. The initial course pointing adjustment may be determined mathematically based on the known satellite coordinates and the vehicle's GPS/Inertial Navigation System (INS) based local coordinates. A processor in a hybrid satellite antenna may also monitor 801 signal strength at a desired frequency through a receiving array. The processor may monitor signal strength for some absolute value, or for the strongest possible signal within the capabilities of the hybrid satellite antenna. Sequential lobing techniques may be used with ESA electronically steering to rapidly lock to the satellite's receive signal. The processor may then adjust 802 the orientation of the hybrid satellite antenna in the azimuth by actuating a motor to rotate the hybrid satellite antenna about an axis substantially perpendicular to the plane of the horizon. The processor may stop the motor based on some determination that no further gross adjustments in the azimuth are necessary or beneficial. The process may make such determination based on continual monitoring 800 of signal strength, or based on other factors known in the art. The processor may then adjust 804 the azimuth orientation of a beam by electronically manipulating array cells in phased array columns in a combined phased array in the hybrid satellite antenna. The processor may continue to electronically adjust the combined phased array until an optimal azimuth orientation is achieved within 0.5°. Optimal azimuth orientation may be defined by signal strength or other factors known in the art. The processor may then adjust 806 the elevation orientation of a beam by electronically manipulating array cells in phased array rows in the combined phased array in the hybrid satellite antenna. The processor may continue to electronically adjust the combined phased array until an optimal elevation orientation is achieved within 0.5°. Optimal elevation orientation may be defined by signal strength or other factors known in the art. One skilled in the art will appreciate that the processor may also utilize information such as known satellite locations and vehicle location based on some global positioning system to make an initial decision as to the orientation of the hybrid satellite antenna.

It is believed that the present invention and many of its attendant advantages will be understood by the foregoing description, and it will be apparent that various changes may be made in the form, construction, and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A hybrid satellite antenna apparatus comprising:

a processor;

memory connected to the processor;

a motor connected to the processor;

a phased array antenna connected to the motor and to the processor; and computer executable program code, wherein, the motor is configured to rotate the phased array antenna about an azimuth axis, the phased array antenna is connected to the motor at a fixed angle relative to an elevation plane substantially perpendicular to the azimuth axis, the fixed angle defined such that a beam from the phased array antenna is electronically steerable between 0° and 90° relative to a horizon, and the phased array antenna is configured to steer a beam in a first dimension and in a second dimension substantially perpendicular to the first dimension.

2. The apparatus of claim 1, wherein the phased array antenna comprises a receiving array and a transmitting array.

3. The apparatus of claim 2, wherein the computer executable program code is configured to monitor a signal strength through the receiving array.

4. The apparatus of claim 3, wherein the computer executable program code is further configured to actuate the motor to orient the phased array antenna toward an azimuth.

5. The apparatus of claim 4, wherein the computer executable program code is further configured to electronically steer a beam projecting from the phased array antenna toward the azimuth within 0.5°.

6. The apparatus of claim 2, wherein the computer executable program code is further configured to electronically steer a beam projecting from the phased array antenna toward an elevation.

7. The apparatus of claim 1, wherein the first dimension is configured to be an azimuth and the second dimension is configured to be an elevation.

8. The apparatus of claim 7, wherein the fixed angle relative to the elevation plane substantially perpendicular to the azimuth axis is configured so that the second dimension remains above the horizon when the apparatus is configured to be installed in a surface vehicle.

9. The apparatus of claim 1, wherein the motor is configured to rotate the phased array antenna at least 60°/s.

10. The apparatus of claim 1, wherein the motor is configured to produce angular acceleration of at least $120°/s^2$.

11. A hybrid satellite antenna apparatus comprising:

a processor;

memory connected to the processor;

a motor connected to the processor;

a phased array antenna, comprising a receiving array and a transmitting array, connected to the motor and to the processor; and computer executable program code, wherein, the motor is configured to rotate the phased array antenna about an azimuth axis, the phased array antenna is connected to the motor at a fixed angle relative to an elevation plane substantially perpendicular to the azimuth axis, the fixed angle defined such that a beam from the phased array antenna is electronically steerable between 0° and 90° relative to a horizon, the fixed angle relative to the plane substantially perpendicular to the azimuth axis is configured so that a second dimension remains above the horizon when the apparatus is configured to be installed in a surface vehicle; and the phased array antenna is configured to steer a beam in a first dimension configured to be an azimuth and in the second dimension configured to be an elevation, substantially perpendicular to the first dimension.

12. The apparatus of claim 11, wherein the computer executable program code is configured to:

monitor a signal strength through the receiving array;

actuate the motor to orient the phased array antenna toward an azimuth;

electronically steer a beam projecting from the phased array antenna toward the azimuth within 0.5°; and electronically steer a beam projecting from the phased array antenna toward an elevation.

13. The apparatus of claim 11, wherein the motor is configured to rotate the phased array antenna at least 60°/s.

14. The apparatus of claim 11, wherein the motor is configured to produce angular acceleration of at least $120°/s^2$.

15. A method for orienting a hybrid antenna comprising:

monitoring a signal strength through a receiving array in a phased array antenna fixedly mounted to an azimuthal motor in an elevation plane, at an angle defined such that a beam from the phased array antenna is electronically steerable between 0° and 90° relative to a horizon;

actuating a motor to orient the phased array antenna toward an azimuth;

steering a beam electronically from the phased array antenna toward the azimuth; and steering the beam electronically from the phased array antenna toward an elevation.

16. The method of claim 15, further comprising determining an initial pointing adjustment of at least one of the azimuthal motor, elevation scan or azimuth scan of the hybrid antenna based on one or more known satellite coordinates and at least one of GPS or INS local coordinates.

17. The method of claim 15, wherein steering the beam electronically from the phased array antenna toward the elevation is performed to within 0.5° of a desired elevation.

18. The method of claim 15, further comprising actuating the motor to maintain an orientation of the phased array antenna.

19. The method of claim 15, further comprising steering the beam electronically to maintain a directional projection of the beam toward the azimuth.

20. The method of claim 15, further comprising steering the beam electronically to maintain a directional projection of the beam toward the elevation.

* * * * *